US009909837B2

(12) United States Patent
Gainer

(10) Patent No.: US 9,909,837 B2
(45) Date of Patent: Mar. 6, 2018

(54) ROCKET EXTRACTION DEVICE AND METHOD

(71) Applicant: The United States of America, as Represented by the Secretary of the Army, Washington, DC (US)

(72) Inventor: Michael Harvey Gainer, Hugo, OK (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 187 days.

(21) Appl. No.: 14/825,769

(22) Filed: Aug. 13, 2015

(65) Prior Publication Data

US 2017/0045323 A1 Feb. 16, 2017

(51) Int. Cl.
*F41F 3/058* (2006.01)
*F41F 3/073* (2006.01)

(52) U.S. Cl.
CPC ..... *F41F 3/073* (2013.01); *F41F 3/058* (2013.01)

(58) Field of Classification Search
CPC .. F41F 3/073; F41F 3/058; B25B 1/00; B25B 3/00; B25B 5/00; B66C 1/62; Y10T 29/49822; Y10T 29/49815
USPC ..... 29/278, 270, 255; 294/90, 86.33
See application file for complete search history.

(56) References Cited

U.S. PATENT DOCUMENTS 4,588,222 A * 5/1986 Martin ..... B25B 9/00 294/106
4,635,336 A * 1/1987 Ades ..... B23P 11/025 29/252
7,434,302 B2 * 10/2008 Hetschel ..... B23Q 7/043 29/255

* cited by examiner

*Primary Examiner* — Jason L Vaughan
*Assistant Examiner* — Amanda Meneghini
(74) *Attorney, Agent, or Firm* — U.S. Army; Kristin Kohler

(57) ABSTRACT

A rocket extraction device and method is disclosed. In one embodiment, the device comprises an upper and a lower casing; an interior cutout in each of the upper and lower casings, the interior cutouts having contours matching exterior surface contours of a rocket fuze; an upper fuze clamp and a lower fuze clamp disposed respectively within the upper and lower casings, each upper and lower fuze clamp having interior surface contours matching exterior surface contours of the rocket fuze; a clamp adjustment screw onto which the upper fuze clamp is mountable; an adjustment wheel mountable at the exterior end of the clamp adjustment screw by which the clamp adjustment screw and the upper fuse clamp are movable to secure the upper and lower fuze clamps to the fuze and force the fuze into the contours of the lower fuze clamp and the interior cutout of the lower casing to lock the fuze into the rocket extraction device. There is an eyebolt or similar type device mountable to the exterior of the rocket extraction device, to which force is applied to remove a rocket from a storage tube. In another embodiment, the method comprises attaching the rocket extraction device securely to a fuze on a rocket and pulling on the rocket extraction device to remove the rocket from a storage tube.

11 Claims, 4 Drawing Sheets

ROCKET EXTRACTION DEVICE AND METHOD

FIELD OF THE INVENTION

The present invention primarily relates to equipment used for demilitarization of Multiple Launch Rocket System (MLRS) rockets, including, for example, those known as the M26 MLRS rockets. The demilitarization process begins with removing the rockets from their protective storage tubes. Once removed, the rockets may then be dismantled and rendered inoperable. It is the initial step of removing the rockets from their storage tubes to which the invention relates.

BACKGROUND OF THE INVENTION

Demilitarization of rockets and rocket launching systems such as the M26 MLRS refers to the destruction or removal of all hazardous components of the rockets and rocket launching systems. To do this requires first removing the rockets from the storage tubes of their storage tube pods (a pod contains 6 storage tubes). This can be done from the aft or forward end of the storage tube.

In the case of aft extraction, current methods utilize a clamp attached to the rocket restraint lugs and a retractable cable connected to the clamp. As the cable is retracted the clamp pulls the rocket out of the aft end of the storage tube. The problem with this method is that a substantial amount of work and time is required to remove ancillary items in/on the rocket storage tube so that the rocket will be clear to slide from the storage tube.

In the case of forward extraction, a current method uses an expandable collet which is inserted into the orifice on the forward end of the rocket fuze, for example an M445 fuze, and then manually expanded inside a cavity inside the fuze. Once expanded, the collet is too large to slip back through the orifice and so is locked into the cavity. A cable is then attached to the collet and as the cable is retracted the collet pulls the rocket out of the forward end of the storage tube.

Due to the difficulty of aft extraction, forward extraction is currently the preferred method. However, there are two problems with forward extraction. First, as a collet is repeatedly used, the expandable fingers on it permanently deform. When this happens the collet no longer has the capability to lock solidly inside the fuze cavity. This allows the collet to slip out of the fuze orifice when the extraction cable is brought under tension. The collet then becomes a flying missile endangering personnel in the area. The second problem relates to the dimensional tolerances used when the rocket fuzes are manufactured. As with any manufactured item, the exact dimensions of the fuzes, and the orifices thereof, vary from part to part by the allowable tolerances specified. This allowable variation in actual orifice diameter from fuze to fuze creates a situation where at times the expandable collet is too large to fit into the fuze orifice and at others it is too small and will not expand enough to lock into the fuze. In either case this leaves the demilitarization process with no viable means to remove the rockets from their storage tubes.

Thus, there is the need for a reliable, repeatable, safe device and method for removing rockets from their storage tubes, for demilitarization of the rockets.

SUMMARY OF THE INVENTION

The present invention discloses a rocket extraction device and method. In one embodiment, the device comprises an upper and a lower casing; an interior cutout in each of the upper and lower casings, the interior cutouts having contours matching exterior contours of a rocket fuze and exterior contours of an upper fuze clamp and a lower fuse clamp; the upper fuze clamp and lower fuze clamp disposed respectively within the upper and lower casings, each upper and lower fuze clamp having interior surface contours matching the exterior surface contours of the rocket fuze; a clamp adjustment screw onto which the upper fuze clamp is mountable; an adjustment wheel mountable at the exterior end of the clamp adjustment screw by which the clamp adjustment screw and the upper fuse clamp are movable to secure the upper and lower fuze clamps to the fuze; and an eyebolt or similar device mountable to the exterior of the rocket extraction device, to which force is applied to remove a rocket from a storage tube. In another embodiment, the method comprises attaching the device securely to a fuze on a rocket and pulling on the fuze to remove the rocket from a storage tube.

BRIEF DESCRIPTION OF THE DRAWINGS

A better understanding of the invention and its advantages will be readily apparent when considering the following brief description in accompaniment with the drawings.

FIG. 1 is a top plan view of the device of the present invention, showing the cross sectional line A-A from which

FIG. 2 is an elevation cross sectional view, taken along line A-A of FIG. 1, showing the internal parts of the present invention and a side view of an M445 fuze showing its surface contours.

DETAILED DESCRIPTION OF THE INVENTION

Figure 1:
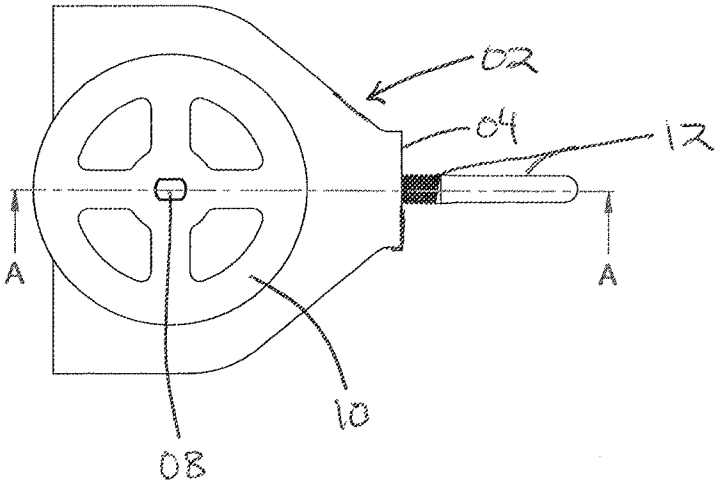

Like reference numerals denote like elements throughout the Figures and text.

Figure 2:
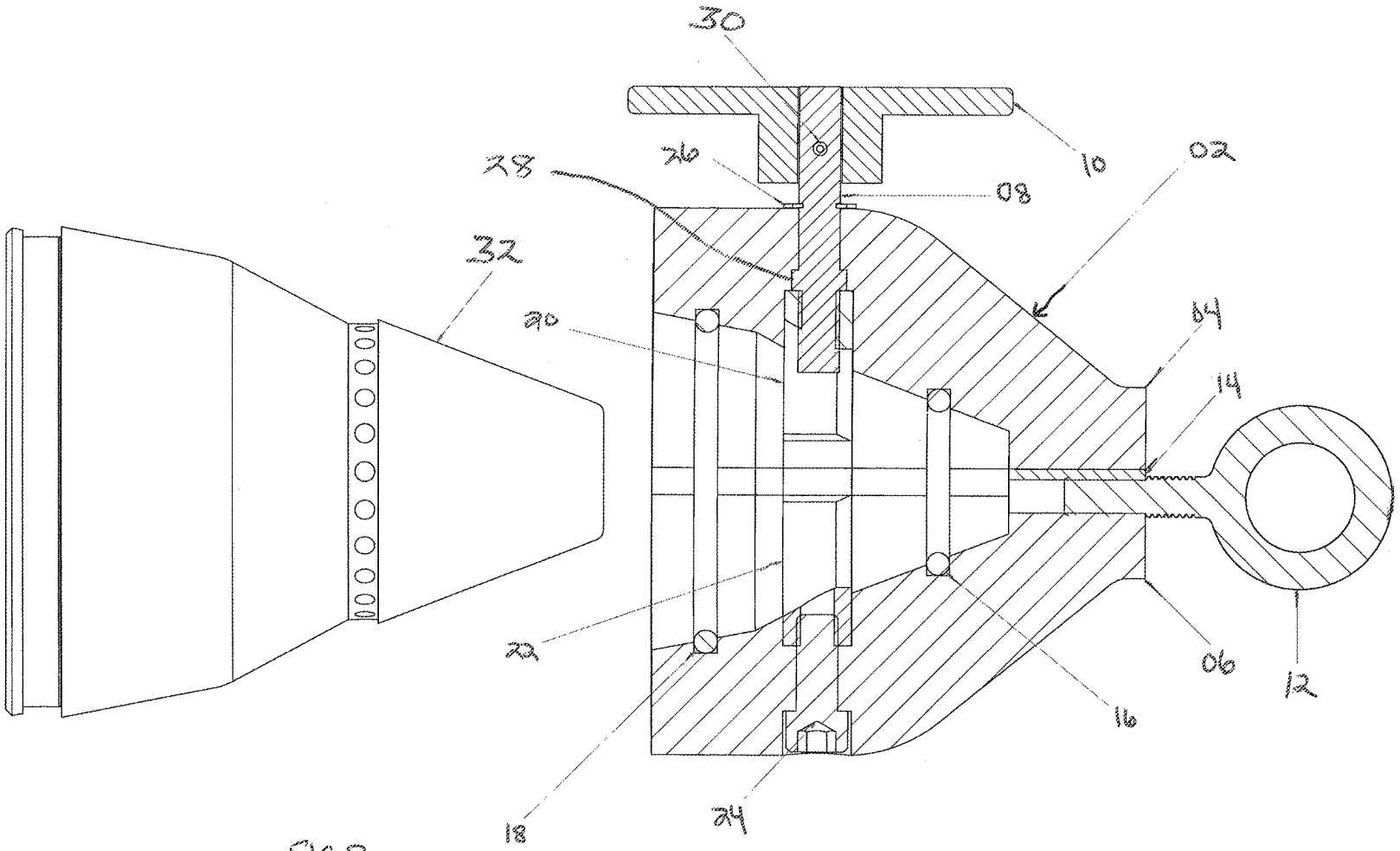
FIG. 2 is taken.

FIG. 1 shows the rocket extraction device 02 of the present invention which has an upper casing 04 and a lower casing 06 (not visible in the plan view of FIG. 1, see FIG. 2). The device has a clamp adjustment screw 08, which is disposed through upper casing 04 and is activated by an adjustment wheel 10. On the forward end of the rocket extraction device 02 is an eyebolt 12 or similar device such as a ring or hook to which a cable (not shown) can be attached to pull on the rocket extraction device 02 to remove a rocket from a storage tube. The device is more fully illustrated in FIG. 2, which is an elevation cross sectional view, taken along line A-A of FIG. 1.

Referring to FIG. 2, rocket extraction device 02 is provided with upper casing 04 and lower casing 06, each having interior cutouts shaped to match exterior surface contours of a rocket fuze 32, but of slightly larger size, so that fuze 32 can fit inside rocket extraction device 02 before it is locked in place inside rocket extraction device 02. The interior cutouts of upper and lower casings 04 and 06 follow the linear contours of fuze 32 so they can slide from the tip portion of fuze 32 down along the body of fuze 32. It is the exterior surface contours of rocket fuze 32 onto which the present invention locks to enable rocket extraction. While the interior cutouts of upper and lower casings 04 and 06 match the exterior contours of fuze 32, they serve mainly to align fuze 32 in rocket extraction device 02 versus locking onto fuze 32.

Between upper casing 04 and lower casing 06 may be a spacer plate 14. Spacer plate 14 is a flat plate that may be added to allow easier manufacturing of upper and lower casings 04 and 06. It also provides space between upper and lower casings 04 and 06 so fuze 32 has room to move within rocket extraction device 02 prior to being forced down into lower casing 06. If a spacer plate 14 is used, upper casing 04 will not ultimately be in direct contact with fuze 32 when rocket extraction device 02 is locked onto fuze 32. Also shown inside upper and lower casings 04 and 06 are two o-rings 16 and 18. O-rings 16 and 18 are optional and rocket extraction device 02 will function properly with or without them. However, o-rings 16 and 18 provide padding and soften the contact forces between the internal surfaces of rocket extraction device 02 and the external surfaces of fuze 32 when rocket extraction device 02 is placed over fuze 32. Without o-rings 16 and 18, positioning of rocket extraction device 02 onto fuze 32 can scratch or possibly damage either rocket extraction device 02 or fuze 32. O-rings 16 and 18 may be made from any of a variety of materials, as would be known to those of ordinary skill in the art, including by way of non-limiting example, rubber or urethane. However, o-rings 16 and 18 must be soft and flexible enough to perform their function and therefore preferably have a Shore A durometer rating of between about 30 to about 40.

Rocket extraction device 02 also has an upper fuze clamp 20 and a lower fuze clamp 22, disposed, respectively, within upper and lower casings 04 and 06, and each having interior surface contours matching the exterior surface contours of fuze 32, and exterior surface contours that fit within the interior cutouts of upper and lower casings 04 and 06. Along with lower casing 06, upper and lower fuze clamps 20 and 22 form the internal locking mechanism of the present invention which locks onto fuze 32. The internal surface contours of upper and lower fuze clamps 20 and 22 match the external surface contours of fuze 32 closely enough to engage fuze 32 and prevent movement. Thus, when rocket extraction device 02 is secured to fuze 32, it is the upper and lower fuze clamps 20 and 22 which lock onto the fuze 32. Lower casing 06 engages and contacts fuze 32 and there is a small gap between fuze 32 and upper casing 04 regardless of whether a spacer plate 14 is present. This gap is present because the interior cutouts in upper and lower casings 04 and 06 are of a larger diameter than fuze 32 so that fuze 32 will slide into rocket extraction device 02. If they were equal diameter (or smaller diameter) fuze 32 would not fit into rocket extraction device 02. Addition of spacer plate 14 simply provides more space to accommodate possible misalignment between rocket extraction device 02 and fuze 32 when rocket extraction device 02 is initially placed over fuze 32, yet still allows rocket extraction device 32 to be placed over fuze 32 and then adjusted into place and secured onto fuze 32.

Upper and lower fuze clamps 20 and 22 have a semi-circular type shape that engages circumferentially around fuze 32. As rocket extraction device 02 is put over fuze 32, upper and lower casings 04 and 06 slide from the tip of fuze 32 towards back of fuze 32. Upper and lower fuze clamps 20 and 22 can then engage fuze 32 circumferentially after upper and lower casings 04 and 06 have been moved down along the length of fuze 32.

On the exterior of upper casing 04, disposed around clamp adjustment screw 08, is an external retaining ring 26. Retaining ring 26, combined with a boss 28 disposed on clamp adjustment screw 08, serve to limit movement of clamp adjustment screw 08 and prevent clamp adjustment screw 08 from moving vertically within upper casing 04 but allow clamp adjustment screw 08 to rotate freely. Retaining ring 26 may be, for example, an external, side mount, E-type retaining ring such as per ASME B18.27, SAE 1060-1090 steel, with a phosphate finish. Alternately, retaining ring 26 may be any of various types as would be known to those of ordinary skill in the art, such as by way of non-limiting example, C-type, spiral-wound, self-locking, tapered, or reduced cross-section type ring. Connecting the exterior end of clamp adjustment screw 08 with adjustment wheel 10 is a spring pin 30. Spring pin 30 may be for example a slotted type such as per ASME B18.8.2, with SAI 1070 or 1095 steel. Alternatively, spring pin 30 may be any of various types of pin as would be known to those of ordinary skill in the art, such as by way of non-limiting example, cotter, dowel, or taper type pin. Spring pin 30 serves to keep adjustment wheel 10 from sliding off the exterior end of clamp adjustment screw 08. Boss 28 limits movement of clamp adjustment screw 08 and prevents clamp adjustment screw 08 from moving upward (towards the exterior of rocket extraction device 02) when clamp adjustment screw 08 pushes down on upper fuze clamp 20. Retaining ring 26 prevents clamp adjustment screw 08 from moving downward (towards the interior of rocket extraction device 02) when it pulls upward on upper fuze clamp 20. The mechanism of operation is described additionally below.

Rocket extraction device 02 is operated by first rotating adjustment wheel 10 clockwise. This raises upper fuse clamp 20, via its threaded engagement with clamp adjustment screw 08, causing it to retract into the interior cutout of upper casing 04 which is shaped to match exterior surface contours of a rocket fuze and which also matches the exterior shape of upper fuze clamp 20. This allows upper fuse clamp 20 to be retracted out of the way while rocket extraction device 02 is placed over fuze 32. When upper fuze clamp 20 is fully retracted, rocket extraction device 02 is placed over fuze 32. Rocket extraction device 02 is pushed onto fuze 32 until its forward motion along fuze 32 stops. Adjustment wheel 10 is then rotated counter-clockwise, and along with it the attached clamp adjustment screw 08 is rotated. As clamp adjustment screw 08 spins on its axis the threads on its exterior engage with a threaded hole in upper fuze clamp 20. As clamp adjustment screw 08 rotates, upper fuze clamp 20, into which it is threaded, is forced downward. By way of explanation, this is the same type of mechanism as a screw engaging a nut. If the screw is held in place and spun clockwise it will cause the nut to move closer to the head of the screw. If the screw is held in place and spun counter-clockwise it will cause the nut to move farther away from the head of the screw.

Thus, as clamp adjustment screw 08 rotates when adjustment wheel 10 is rotated counter-clockwise, upper fuze clamp 20 moves downward and engages the exterior surface contours of fuze 32 which forces fuze 32 to mate into the interior surface contours of lower fuze clamp 22 and the interior cutout of lower casing 06. Lower casing 06 aligns with and contacts fuze 32 while upper and lower fuze clamps 20 and 22 lock onto the surface of fuze 32. It is the threaded engagement of clamp adjustment screw 08 and upper fuze clamp 20 which not only allows considerable force to be applied to push fuze 32 down into lower fuze clamp 22 and lower casing 06, but which also develops the friction between the mating threaded surfaces of clamp adjustment screw 08 and upper fuze clamp 20 that prevents upper fuze clamp 20 from moving or backing away from the surface of fuze 32 once tightened. Clamp adjustment screw 08 only moves when adjustment wheel 10 is turned which allows the rocket extraction device 02 to retain a tight grip on the surface of fuze 32 and allows the mechanism to work effectively.

A cable or other such type device can then be attached to eyebolt 12, or similar device such as a ring or hook as would be known to those of ordinary skill in the art, and retracted. As the cable is retracted, the interlocking surfaces between rocket extraction device 02 and fuze 32 allow the rocket to be pulled safely and effectively from its storage tube.

Figure 3:
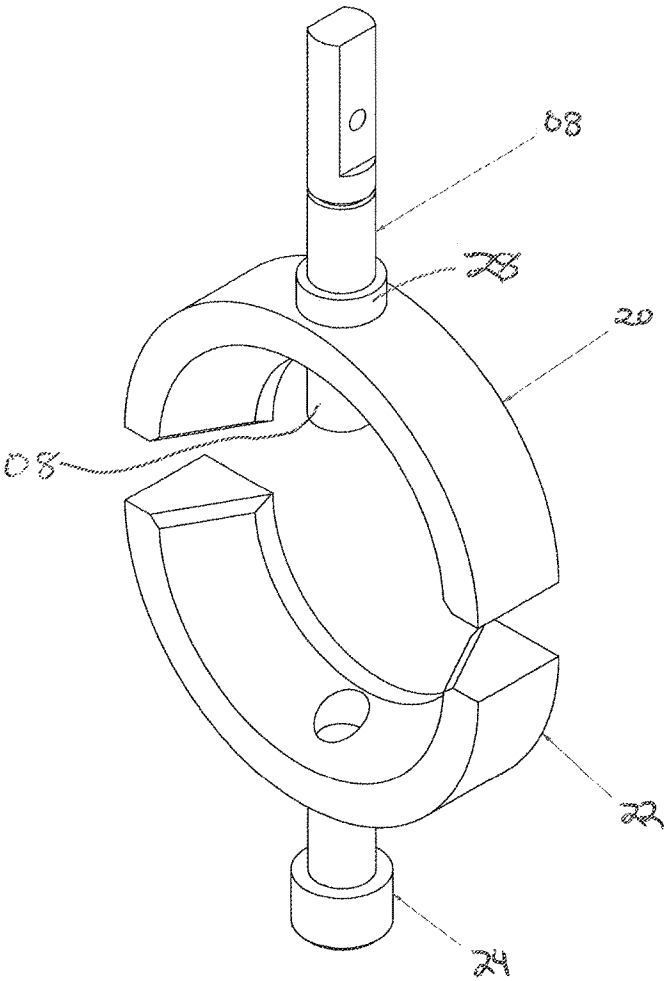
FIG. 3 is an isometric view of the upper and lower fuze clamps of the present invention.
Figure 3A:
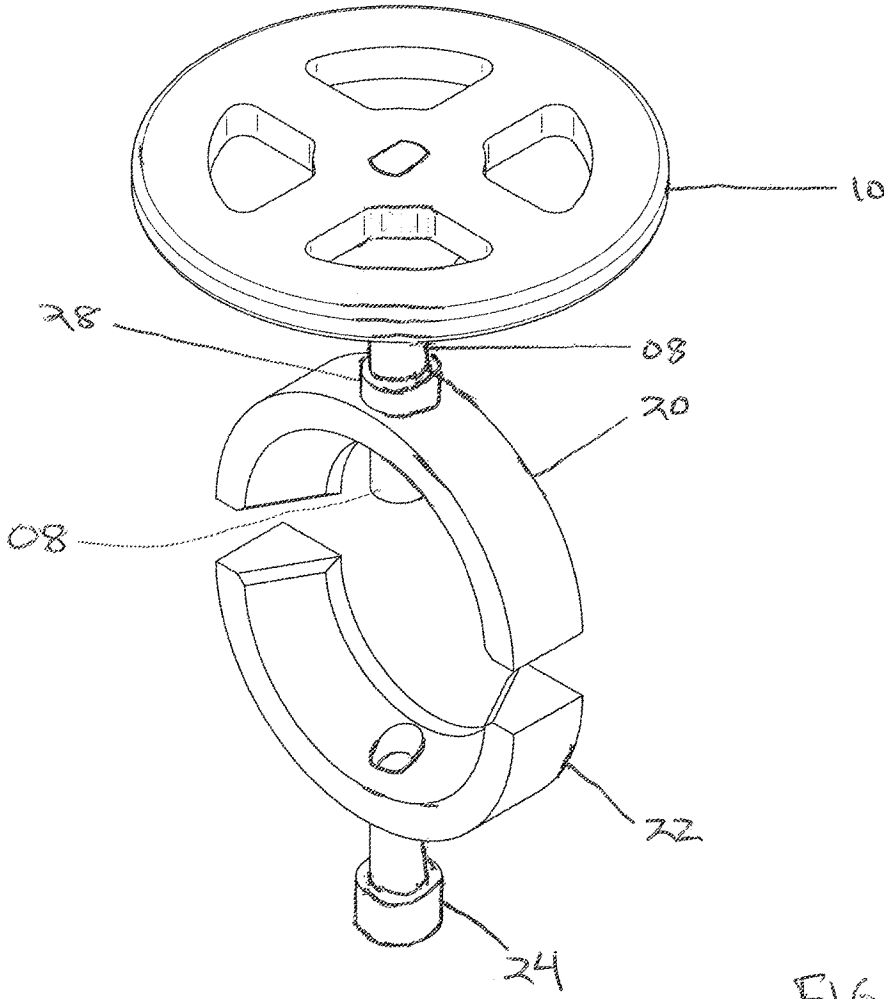
FIG. 3A is an isometric view of the upper and lower fuze clamps and the adjustment wheel of the present invention.

Referring now to FIG. 3, this Figure is an isolated view of only upper fuze clamp 20, lower fuze clamp 22, clamp adjustment screw 08 onto which upper fuze clamp 20 is mountable, and retaining screw 24 which attaches lower fuze clamp 22 firmly to lower casing 06 to prevent relative movement between the two. Adjustment wheel 10 is mountable at the top (exterior end) of clamp adjustment screw 08, as shown in FIG. 3A, by which clamp adjustment screw 08 and upper fuse clamp 20 are movable. Upper fuze clamp 20 has, at its top center, a threaded hole extending through it which engages with the external screw threads on clamp adjustment screw 08. As shown in FIG. 3 and FIG. 3A, clamp adjustment screw 08 can be seen extending through upper fuze clamp 20. As explained above, as adjustment wheel 10 is turned clockwise, upper fuze clamp 20 is raised out of the internal cavity of rocket extraction device 02 and into a portion of the interior cutout in upper casing 04. In this position, rocket extraction device 02 is ready to be placed onto fuze 32. As adjustment wheel 10 is then rotated counter-clockwise, this lowers upper fuze clamp 20 until its interior surface contours engage and lock with the external surface contours of fuze 32. Rocket extraction device 02 is then ready to be used to extract a rocket from its storage tube. Due to the friction of the mating of threads of clamp adjustment screw 08 and upper fuze clamp 20, upper fuze clamp 20 can only be loosened if clamp adjustment screw 08 is manually reversed by turning adjustment wheel 10. Lower fuze clamp 22 may be permanently fixed inside lower casing 06 with retaining screw 24, as shown in FIG. 3 and FIG. 3A, or could be movable, though this embodiment of the invention is not shown, but would be understood by those of ordinary skill in the art.

The present invention utilizes a positive locking rocket extraction device 02 to extract rockets from their storage tubes, and is particularly suited for use with the M445 fuze as used on M26 MLRS rockets. The present invention extracts the rockets by pulling them from the forward end of the storage tubes. An M445 fuze is formed from aluminum such that it can be readily lifted and handled. The invention readily and easily locks onto an M445 fuze while not being susceptible to loosening and slipping off due to wear from repeated use. The invention is also not affected by actual fuze dimensions as it is designed to accommodate fuzes at the outer ends of the allowable dimensional manufacturing tolerances for such fuzes.

Although specific embodiments have been illustrated and described herein, it would be understood by those of ordinary skill in the art that various modifications are possible without deviating from the spirit of the present invention. Accordingly the scope of the invention is limited only by the claims.

What is claimed is:

1. A rocket extraction device comprising:

an upper and a lower casing;

an interior cutout in each said upper and lower casing, said interior cutouts matching exterior surface contours of a rocket fuze;

an upper fuze clamp and a lower fuze clamp disposed respectively within said upper and lower casings, and each having interior surface contours matching said exterior surface contours of said rocket fuze;

a clamp adjustment screw threadedly disposed through said upper fuze clamp;

an adjustment wheel mountable at an exterior end of said clamp adjustment screw by which said clamp adjustment screw and said upper fuse clamp are movable; and an eyebolt type device fixedly mountable to an exterior of said rocket extraction device.

2. The rocket extraction device of claim 1 comprising at least one o-ring disposed within said upper and lower casings.

3. The rocket extraction device of claim 2 wherein said at least one o-ring has a Shore A durometer rating of from about 30 to about 40.

4. The rocket extraction device of claim 1, wherein said interior surface contours of said upper and lower fuze clamps match said exterior surface contours of a fuze such that said interior surface contours of said upper and lower fuze clamps provide positive engagement between said fuze and said rocket extraction device and prevent relative movement between said upper and lower fuze clamps and said fuze.

5. The rocket extraction device of claim 4, wherein said interior cutouts of said upper and lower casings match said external surface contours of said fuze, such that said interior cutouts of said upper and lower casings, in combination with said interior surface contours of said upper and lower fuze clamps, provide engagement between said fuze and said rocket extraction device and prevent relative movement between said upper and lower fuze clamps, said lower fuze casing, and said fuze.

6. The rocket extraction device of claim 1, wherein said clamp adjustment screw, threadedly disposed through said upper fuze clamp, is not susceptible to movement unless said adjustment wheel is turned.

7. The rocket extraction device of claim 1, wherein said lower fuze clamp is fixedly mounted to said lower casing.

8. The rocket extraction device of claim 1, further comprising a retaining ring disposed on the exterior of said upper casing, which said retaining ring limits movement of said clamp adjustment screw downward.

9. The rocket extractor device of claim 8 further comprising a boss disposed on said clamp adjustment screw which said boss limits movement of said clamp adjustment screw upward.

10. The rocket extractor device of claim 1 further comprising a spacer plate disposed between said upper and lower casings.

11. A method of extracting a rocket from a storage tube comprising the steps of:

placing a rocket extraction device over a fuze of a rocket contained in a storage tube;

rotating an adjustment wheel and a clamp adjustment screw;

forcing, thereby, an upper fuze clamp, disposed in an upper casing and through which said clamp adjustment screw is threaded, downward toward said fuze such that interior surface contours of said upper fuze clamp engage exterior surface contours of said fuze, forcing, thereby, said fuze to mate with interior surface contours of a lower fuze clamp disposed within a lower casing, and to mate with an interior cutout in said lower casing, securing, thereby, said rocket extraction device onto said fuze; and exerting a force onto an eye bolt type device disposed at a forward end of said rocket extraction device to pull on said rocket extraction device and remove said rocket from said storage tube.

* * * * *